US006447305B1

(12) United States Patent
Roberts

(10) Patent No.: US 6,447,305 B1
(45) Date of Patent: Sep. 10, 2002

(54) CIRCUIT TO PRINTED CIRCUIT BOARD STORED ENERGY CONNECTOR

(75) Inventor: Joseph A. Roberts, Hudson, NH (US)

(73) Assignee: Miraco, Inc., Manchester, NH (US)

( * ) Notice: Subject to any disclaimer, the term of this patent is extended or adjusted under 35 U.S.C. 154(b) by 117 days.

(21) Appl. No.: 09/592,834

(22) Filed: Jun. 13, 2000

Related U.S. Application Data

(60) Continuation-in-part of application No. 09/206,779, filed on Dec. 7, 1998, now Pat. No. 6,074,220, which is a division of application No. 08/645,671, filed on May 14, 1996, now Pat. No. 5,873,739.

(51) Int. Cl.[7] ..... H01R 12/00

(52) U.S. Cl. ..... 439/67; 439/260; 439/495

(58) Field of Search ..... 439/67, 493, 494, 439/495, 499, 634, 635, 636, 77

(56) References Cited

U.S. PATENT DOCUMENTS 5,580,272 A * 12/1996 Yamaguchi et al. ..... 439/495
5,842,883 A * 12/1998 Igarashi et al. ..... 439/495
5,904,586 A * 5/1999 Takayasu ..... 439/260
6,056,572 A * 5/2000 Matsumoto et al. ..... 439/260

* cited by examiner

*Primary Examiner*—Brian Sircus
*Assistant Examiner*—Michael C. Zarroli
(74) *Attorney, Agent, or Firm*—Devine, Millinet & Branch, P.A.; Paul C. Remus; Todd A. Sullivan

(57) ABSTRACT

A circuit to printed circuit board stored energy connector. The connector precisely aligns and interconnects conductors of "flexible circuits" (including conductive ink circuits (CIC), flexible printed circuits (FPC), and/or flat flexible cables (FFC)) directly to mating contacts on printed circuit boards. The connector is a zero insertion force (ZIF) type, and is a high density surface mount. The connector comprises mainly an actuator with an activation ridge, a deflectable flat spring contact in a spring support module, and circuit alignment features that use the flexible circuit's existing features—the outline and conductors—to accurately align the conductors of the flexible circuit to their corresponding mating spring contacts. The connector also includes circuit locators, a circuit compression flap and conductor alignment notches which work cooperatively to align and interconnect a flexible circuit to its spring contact. The connector provides a micro-wiping action that will not damage the flexible circuit, and also provides secure connection with a two point, redundant contact.

7 Claims, 4 Drawing Sheets

CIRCUIT TO PRINTED CIRCUIT BOARD STORED ENERGY CONNECTOR

This Application is a Continuation In Part of application Ser. No. 09/206,779, filed Dec. 7, 1998, (now allowed) now U.S. Pat. No. 6,074,220, which is a Divisional of application Ser. No. 08/645,671, filed May 14, 1996, and currently issued as U.S. Pat. No. 5,873,739, and also claims priority to a Provisional Application, filed May 31, 2000.

FIELD OF THE INVENTION

This invention relates to electrical connectors. More particularly this invention relates to zero insertion force electrical connectors. Most particularly this invention relates to a low cost, high density connector to interconnect primarily conductive ink circuits (CIC), flexible printed circuits (FPC), and/or flat flexible cables (FFC), with out the presence of at least one additional stiffener, as required with conventional zero insertion force connectors.

BACKGROUND OF THE INVENTION

In today's electronics market, manufacturers are placing emphasis on increasing their product's reliability and reducing assembly costs to remain competitive. A primary focus of each manufacturer is to reduce the cost and increase the circuit density associated with interconnecting the sub-assemblies and components found within its products. Another emerging focus in today's electronics market is to pack more electronic functions into smaller packages. This means higher density (for example 0.0125 inches on center) modules, each requiring multiple high density interconnections to other modules.

In electrical systems, flexible printed circuits are employed as electrical jumpers or cables for interconnecting rows of terminal pins or pads of printed circuit boards. Such flexible printed circuits are generally connected to a printed circuit board using a connector. Conventional connector manufacturers compete with each other using the same basic technology, individual stamped contacts molded into a plastic housing. This structure is then soldered to a printed circuit board (PCB) and is then ready to receive a flexible jumper or interconnect circuit. Many of these conventional connectors are of the zero insertion force (ZIF) variety, which require the application of minimal forces during the process of inserting the flexible circuit into the connector. These ZIF connectors thus reduce the likelihood of circuit damage during the connection process.

All of today's ZIF connectors use either the edge of the interconnect circuit or a precisely located hole to accurately align the conductors of the flexible circuit to the connector's contacts. This requires circuit manufacturers to precisely control both the thickness and width of a flexible circuit's terminating ends. If a circuit is too thin, the contacts will not attain the required deflection needed to achieve and maintain the desired contact force. Generally, tolerances must be maintained within 0.003 inches. To accurately outline a circuit and control the required tolerances requires an expensive precise outline die.

Another obstacle encountered in conventional circuit connector technology centers around a tendency of flexible circuits to shrink somewhat after their manufacture. When working with larger flexible circuits, the shrinkage problem can be significant enough to result in significant alignment problems. As such, outline dies are usually constrained to outline a 6 inch by 6 inch area. This size restriction adds labor costs and reduces yield.

In addition to size restrictions, flexible circuits also require the precise attachment of a support stiffener. This stiffener is required to lift the flexible circuits into connection with a conventional connector's contacts and add the structural support necessary to ensure the thin flexible circuit enters into the connector's opening. The precise outlining and stiffener attachment process is cumbersome and costly, and frequently the cause of poor yields and system failures.

In addition, existing ZIF connectors incorporate a high pressure wiping contact system. This approach, although effective on copper circuits, destroys conductive ink circuits (CIC).

Existing ZIF connectors also do not adequately restrain the flexible circuit and are notorious for having circuits pop out during assembly and even during use. The inability of current systems to adequately restrain the circuit leads to the potential of causing a catastrophic system failure. To add to the instability problem, existing connectors offer a one point contact system. Having only one point of contact has been a source of numerous failures attributed to contact falling over plating voids, a spot of adhesive or other foreign material on the conductor of the flexible circuit.

Thus, there is a need for a low cost, high density, circuit to printed circuit board stored energy connector that can interconnect the delicate contacts of conductive ink circuits, flexible printed circuits, and/or flat flexible cables to printed circuit boards.

SUMMARY OF THE INVENTION

A circuit to printed circuit board stored energy connector is disclosed which is intended to be a low cost, high density connector. Also disclosed is a method of interconnection using the connector of the present invention. The connector is designed to precisely align and interconnect conductors of conductive ink circuits (CIC), flexible printed circuits (FPC), round wire interconnects (RWI) and/or flat flexible cables (FFC), (collectively referred to hereinafter as "flexible circuits") to a conductive spring in the connector. The spring is then connected to mating contacts on printed circuit boards (PCB's). The disclosed connector relies in part upon the flexible circuit conductors themselves for alignment purposes and thus eliminates the need for precise control of the outside dimensions of a flexible circuit's dielectric backplane or a precisely located alignment hole in the flexible circuit. The connector is of the zero insertion force (ZIF) variety and is a high density surface mount connector capable of terminating conductors on 0.006 inch pitch centers.

The disclosed circuit to printed circuit board stored energy connector comprises the following major components: an actuator that cooperates with a component retaining shell, and at least one spring contact housed in a spring support module.

The connector uses the flexible circuit's existing features (its outline and conductors) to initially accurately align the conductors of the flexible circuit to their mating spring contacts in the connector. Unlike previous systems, the invention uses a "built-in" circuit to contact alignment mechanism. The mechanism includes circuit locating arms, a circuit compression flap, and conductor alignment notches. For initial general alignment, the flexible circuit is slid into a circuit alignment cavity which allows the tapered alignment notches to accurately locate the leading edge of the flexible circuit. The flexible circuit is held in place by a circuit retaining button designed to deflect the flexible circuit into a receptacle found in the component retaining shell.

In order to further align the flexible circuit in the connector, circuit locating arms, positioned on each side of the flexible circuit aid in locating the conductors of the flexible circuit over the tapered alignment notches. Finally, as an actuator is closed over the flexible circuit, the compression flap forces the conductors of the flexible circuit into the tapered alignment notches, completing the alignment process. Circuit to circuit (flexible circuit to printed circuit board) interconnection is then achieved as the actuator applies the force necessary to provide the desired contact pressure between the subject circuit and the spring contact. A micro-wiping action occurs as the spring contact slides across the back of the dielectric of the flexible circuit while applying an ever increasing force to each contact of the flexible circuit until the desired interconnection results are achieved. To further insure a stable contact, the invention provides a redundant two point contact.

Thus an aspect of the invention is to provide a low cost, high density connector usable with conductive ink circuits, flexible printed circuits, and/or flat flexible cable.

Another aspect of the invention is to provide a connector that does not require the attachment of any added stiffeners in order to align a subject circuit to its contacts.

A further aspect of the invention is that the invention does not require that the thickness of the subject circuit be tightly controlled. The invention can accommodate varying thicknesses.

A still further aspect of the invention is that the invention eliminates the need for strain relief/alignment holes to be installed in the subject circuit by using the subject circuit itself to aid in alignment.

Yet another aspect of the invention is that the invention eliminates the conventional high pressure wiping contact of prior connectors, thus allowing the invention to be used with subject circuits that are typically damaged or destroyed by conventional connectors.

Another aspect of the invention provides a two point locking system to lock the subject circuit in place in the connector.

In addition, another aspect of the invention provides redundant two points of contact between the subject circuit and the printed circuit board which enhances reliability.

A further aspect of the invention provides accommodation of varying thickness of the subject circuit, in that the spring contact is self-setting and adjusts to the thickness of the particular circuit inserted into the connector, and provides a less severe wiping contact upon activation of the actuator and spring contact. The spring contact can, however, also be shaped to provide a traditional wiping contact for use with metal based circuits.

A further aspect of the invention is that, because the spring contact is flat and self-setting it is much less expensive and complex to manufacture.

These and further aspects and embodiments of the invention will become readily apparent from the following exemplary detailed description and appended claims.

DETAILED DESCRIPTION OF THE PREFERRED EMBODIMENT

Figure 1:
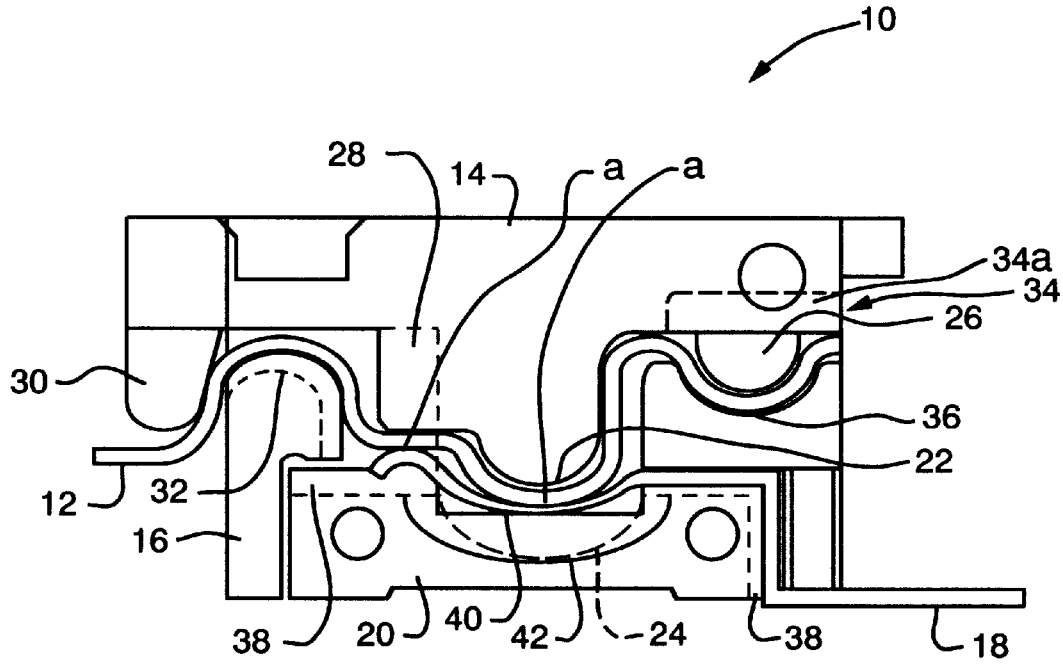
FIG. 1 is a side cut-away view of the whole connector, fully closed and activated.

Referring now to the Figures, in which like reference numerals correspond to like elements throughout, a most basic embodiment of the invention is a circuit to printed circuit board stored energy connector 10 for interconnecting conductive ink circuits (CIC), flexible printed circuits (FPC), and/or flat flexible cables (FFC), hereinafter referred to as at least one "flexible circuit" 12, to a printed circuit board (PCB).

As shown in FIGS. 1-, the connector comprises an actuator or activator 14 that cooperates with a component retaining shell 16, and at least one flexible spring contact 18 housed in a spring support module 20. Spring contact 18 has a lead end which exits connector 10 and is soldered, or otherwise electrically attached or connected, to the PCB. The electrical signal is carried through flexible circuit 12 then passed through spring contact 18 into corresponding contacts on the PCB as flexible circuit 12 and spring contact 18 are pressed together in connector 10.

The actuator 14 interconnects the conductors of flexible circuit 12 to their corresponding individual contacts on spring contact 18 by applying the required engagement force through the back of the dielectric of flexible circuit 12. Actuator 14 slides across the back of the dielectric while applying an ever increasing contact force until it achieves desired, programmed results. The motion of actuator 14 vertically interconnects flexible circuit 12 and spring contact 18 while minimizing contact "wipe" as the connection is made. Minimizing wipe is necessary to prevent fracturing or scraping the fragile conductive ink off of a CIC during the attachment/connection process.

To preform its intended function, actuator 14 has formed thereon a contact activation ridge 22 whose primary function is to apply, on demand, the required force necessary to achieve the desired contact pressure and provide a limited "micro-wipe" between a CIC flexible circuit 12 and spring contact 18. Activation ridge 22 compresses the conductors of flexible circuit 12 against deflectable flat spring contact 18, which holds and compresses the particles of a conductive ink conductor together, as an ever increasing pressure is applied as actuator 14 is closed. This technique allows the limited micro-wipe of the CIC to enhance the contact surface. The micro-wipe occurs as more of the CIC's surface is compressed against deflecting spring contact 18 by activation ridge 22.

Two tapered_circuit locating arms 24 built in to actuator 14 align flexible circuit 12 to spring contact 18. Circuit locating arms 24 eliminate conventional critical circuit outlining and punching operations as well as the need to apply a costly alignment stiffener to the flexible circuit.

A circuit retaining button 26 is also centrally formed as part of actuator 14 and serves as part of the alignment process. Retaining button 26 locks flexible circuit 12 in place, offers strain relief and circuit pull-out (for example from pulling on flexible circuit 12 ), and, because of its central location, allows flexible circuit 12 to pivot on an axis about the location where circuit retaining button 26 is pressing on flexible circuit 12, as circuit locating arms 24 engage and align flexible circuit 12. Flexible circuit 12 is wedged between the circuit locating arms 24 as actuator 14 is closed. thereby placing flexible circuit 12 into position over the tapered conductor alignment notches 32 of component retaining shell 16.

As a final step as actuator 14 is closed, a compression flap 28 formed on actuator 14 forces the conductors of flexible circuit 12 into tapered conductor alignment notches 32 formed in the back wall of component retaining shell 16, thereby completing the alignment process. At least one strain relief extension 30 is formed on actuator 14 to lock flexible circuit 12 in place onto component retaining shell 16 and to prevent externally applied force on flexible circuit 12 from disengaging the connection.

Component retaining shell 16, as mentioned above, and as best shown in FIG. 1, has formed therein tapered conductor alignment notches 32 which automatically align each conductor of flexible circuit 12 to its corresponding contact of spring 18 as actuator 14 is closed. Component retaining shell 16 also contains a circuit receiving cavity 34 to initially align flexible circuit 12 as it is first inserted into connector 10. Circuit receiving cavity 34 has tapered side walls which form tapered alignment wedges 34*a* into which flexible circuit 12 is inserted. Circuit receiving cavity 34 correctly positions the leading edge of flexible circuit 12 as it is initially inserted into connector 10.

There is also a circuit retaining button receptacle 36 formed in component retaining shell 16 to receive circuit retaining button 26 of actuator 14 and the now-depressed flexible circuit 12, thereby allowing flexible circuit 12 to move as circuit locating arms 24 engage and align flexible circuit 12. The interlocking of actuator 14 and its circuit retaining button 26 and compression flap 28 with component retaining shell 16 and its tapered conductor alignment notches 32 prevent contact discontinuity under vibration, and provide an accurate means for aligning each individual contact of flexible circuit 12 to its corresponding mating contact on spring 18.

Spring contact 18 is shown in FIGS. 1–3 and FIGS. 6*a–c,* and may be preferably a flat, flexible "free floating" "bridge" spring. By way of further explanation, conventional contact and/or support springs control their engagement angle, applied force, and depth of deflection by first forming a spring into a pre-defined configuration and then relying on a mating contact to accurately deflect the spring into its pre-defined configuration. Unfortunately, every bend formed introduces a new error or tolerance and all tolerances must be summed to determine the spring contact's required range of motion. A typical contact may require three bends at a +/−0.002 inch tolerance per bend. Three bends would thus require a forgiveness tolerance of 0.006 inches. When backing a flat flexible circuit, a spring must also be capable of accommodating the manufacturing tolerances of the flat flexible circuit, which are typically +/−0.003 inches (in thickness). When the circuit thickness tolerance is added to the spring contact's required "activation range" of 0.006 inches, this results in needing a spring that has a 0.015 inch "active range". This is both mechanically and economically impractical in a connector with a thickness of less than 0.100 inches.

Spring contact 18 eliminates typical tolerance problems associated with a formed spring, and also provides a non-damaging micro-wipe. Spring contact 18 stores and applies the required energy necessary to achieve the desired contact pressure and to provide a micro-wiping action which breaks through surface oxidation on flexible circuit 12 to make a reliable high pressure electrical connection. The micro-wipe is especially important when connecting CIC's because a conventional wiping action, under full contact pressure, would significantly damage the circuit's delicate conductive ink composition.

Figure 6A:
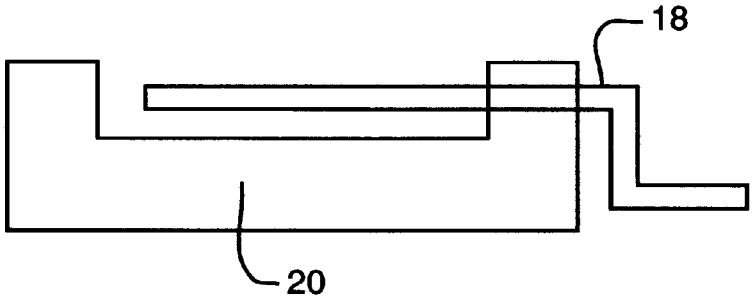
FIG. 6*a* is a simplified side view of the spring contact showing the spring contact with a "free floating" end.
Figure 6B:
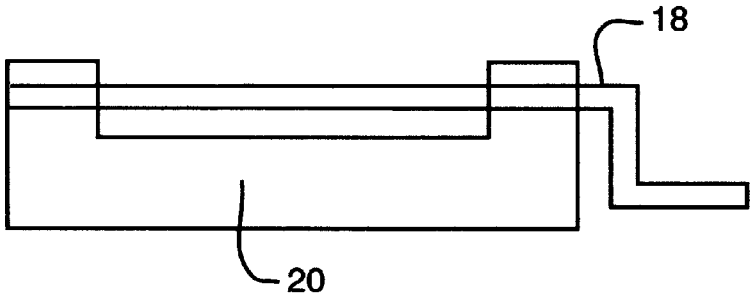
FIG. 6*b* is a simplified side view of the spring contact showing the spring contact as a "bridge".

Spring contact 18 may be a "flat", "bridge" spring, as shown in FIGS. 6*a* and 6*b,* and is free from the typical manufacturing tolerances of formed springs, because it does not require the shaping or bending and heat treatment of a conventional formed spring. In addition, the lack of manufacturing tolerances in spring contact 18 significantly increases its positional accuracy in connector 10, and insures the correct contact force is applied to flexible circuit 12. The present spring contact 18 eliminates structural limitations, including factors such as beam length, width, thickness and material, which control all operating parameters. By eliminating spring contact forming, the present spring contact reduces manufacturing and assembly costs. In addition, the "free floating" or "bridge" end of spring contact 18 can be formed and positioned to any desired shape to accommodate and provide a traditional wiping contact if desired for example for metal based circuits.

FIG. 6*a* shows spring contact 18 with a "free floating" end. With a spring contact 18 that is designed to be restrained at only one end, the unrestrained "free floating" end is free to move as spring contact 18 is deflected, thus offering or allowing a wider range of deflection.

FIG. 6*b* shows spring contact 18 as a complete "bridge", without a completely "free floating" end, (as also shown in FIGS. 1–5) wherein a second, redundant point of contact with each conductor of flexible circuit 12 is provided.

Figure 6C:
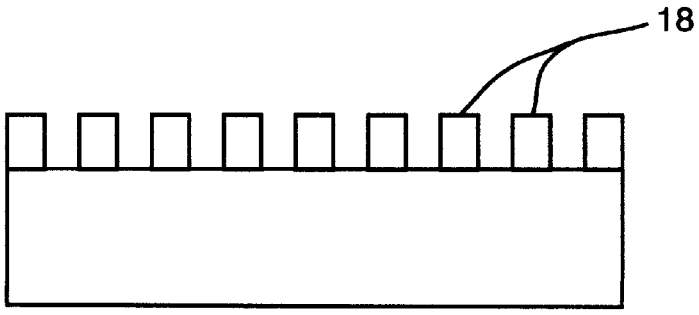
FIG. 6*c* is a top view illustrating the individual contacts of the spring contact.

Each spring contact 18 contains individual spring contacts, as shown in FIG. 6*c* to mate with the individual contacts of flexible circuit 12. Each individual spring contact applies independent contact pressure and in so doing, compensates for the variations/tolerances in thickness of flexible circuit 12, by compressing into conductor alignment notches 32 as required to compensate for thickness variations in flexible circuit 12. Because spring contact 18 is activated for the first time upon insertion of flexible circuit 12 into connector 10, spring contact 18 becomes "self-setting" by adjusting the amount of deflection to the thickness of flexible circuit 12 as actuator 14 is closed. Spring contact 18 may also be tapered to offer significant technical versatility while still maintaining the required contact pressure.

As noted briefly above, spring contact 18 may also be formed in connector 10 such that connector 10 provides a redundant, two point contact, as shown in FIGS. 1–3 and 6*b,* to further enhance the security and reliability of the contact formed in connector 10 by tightly securing flexible circuit 12 in connector 10. Thus even if one point of contact is broken or inadequate, contact is still maintained at the second contact point, thus averting a system failure. The redundant two points of contact are illustrated at letter "a" in FIGS. 1–3.

Spring contact 18 is housed in spring support module 20, as seen in all Figures. Spring support module 20 accurately locates spring contact 18 to the tapered conductor alignment notches/troughs 32 of component retaining shell 16. Spring support module 20 accomplishes alignment of sprint contact 18 using spring contact alignment troughs 38, as shown in FIGS. 1–3 and 5, a contact deflection trough 40 also shown in FIGS. 1–3 and 5, and at least one circuit locating arm receptacle 42 also shown in FIGS. 1–3 and 5.

The invention also comprises a method of interconnecting at least one flexible circuit 12 to a printed circuit board using a connector 10, comprising the steps of: inserting flexible circuit 12 into tapered circuit receiving cavity 34 in component retaining shell 16 to initially align flexible circuit 12 in connector 10; holding flexible circuit 12 essentially in place (while allowing limited movement) using circuit retaining button 26 of actuator 14 and its corresponding circuit retaining button receptacle 36 in component retaining shell 16; using the two circuit locating arms 24 of actuator 14 to align flexible circuit 12 in position over tapered conductor alignment notches 32 (in retaining shell 16) and spring contact 18 (in spring support module 20) as a second alignment step; providing further alignment and support of the connection using locating arm receptacles 42 in spring support module 20 to receive and interact with locating arms 24 of actuator 14; closing actuator 14 onto retaining shell 16 containing flexible circuit 12, wherein compression flap 28 of actuator 14 forces or guides the individual contacts of flexible circuit 12 into tapered alignment notches 32; providing support and additional alignment for spring contact 18 using spring contact alignment troughs 38 to further align the individual contacts of flexible circuit 12 to the individual contacts of spring contact 18 in spring support module 20; applying force, and a non-damaging micro-wipe, to flexible circuit 12 by fully closing actuator 14, using contact activation ridge 22 on actuator 14; whereby the individual contacts of flexible circuit 12 are "micro-wiped" as they are pressed into firm connection with the individual contacts of spring contact 18 in contact deflection trough 40 (into which flexible circuit 12 and spring contact 18 are finally pressed by contact activation ridge 22); and additionally using strain relief extension 30 on actuator 14 to provide further stabilization to the resulting connection. The interconnection is completed by finally soldering or otherwise electrically attaching or connecting the leading edge of spring contact 18 (which extends out from connector 10) to a printed circuit board (not shown). Thus, the method works sequentially to move flexible circuit 12 into alignment with spring contact 18 to connect their respective individual mating contacts.

Figure 2:
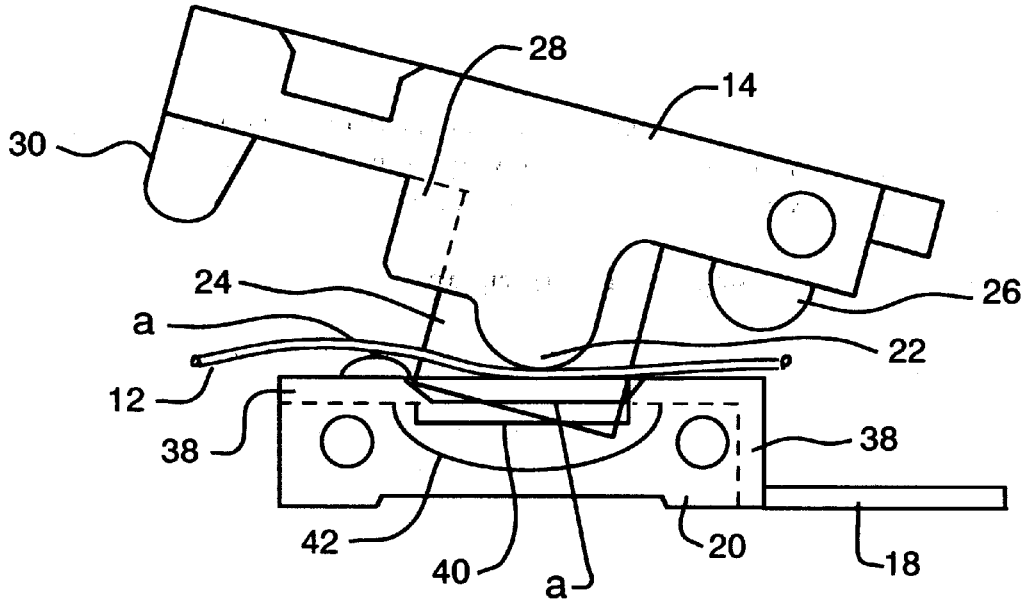
FIG. 2 is a side cut-away view of the actuator/activator and spring support module not yet activated.
Figure 3:
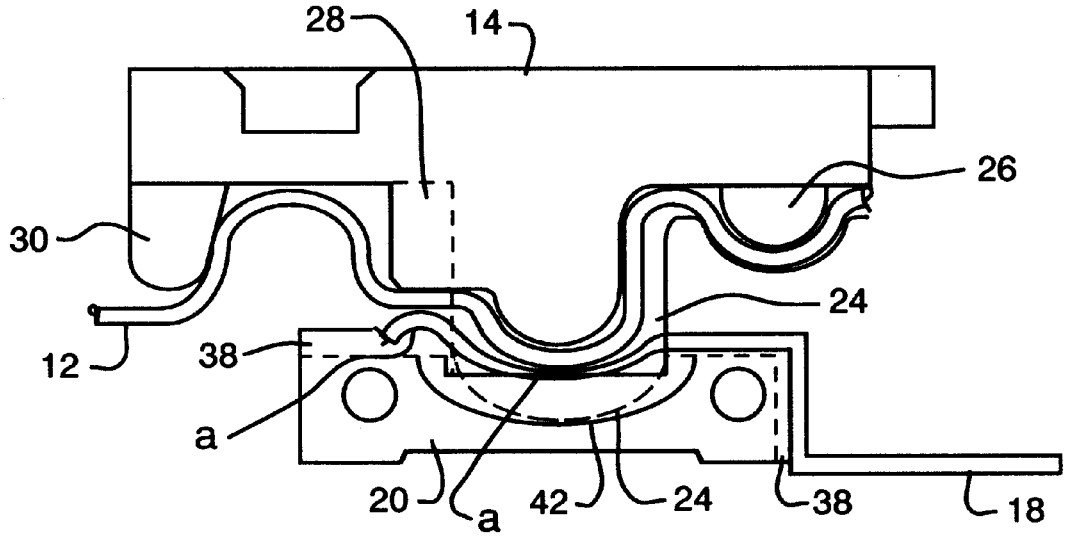
FIG. 3 is a side cut-away view of the actuator/activator and spring support module activated, with redundant contact points.

FIGS. 2 and 3 show the connector (without component retaining shell 16 shown) in first an open, unconnected position (FIG. 2) and then in a closed, connected position (FIG. 3) to illustrate the connection process. FIG. 1 shows the complete connector 10, closed and connected, including component retaining shell 16.

Figure 4:
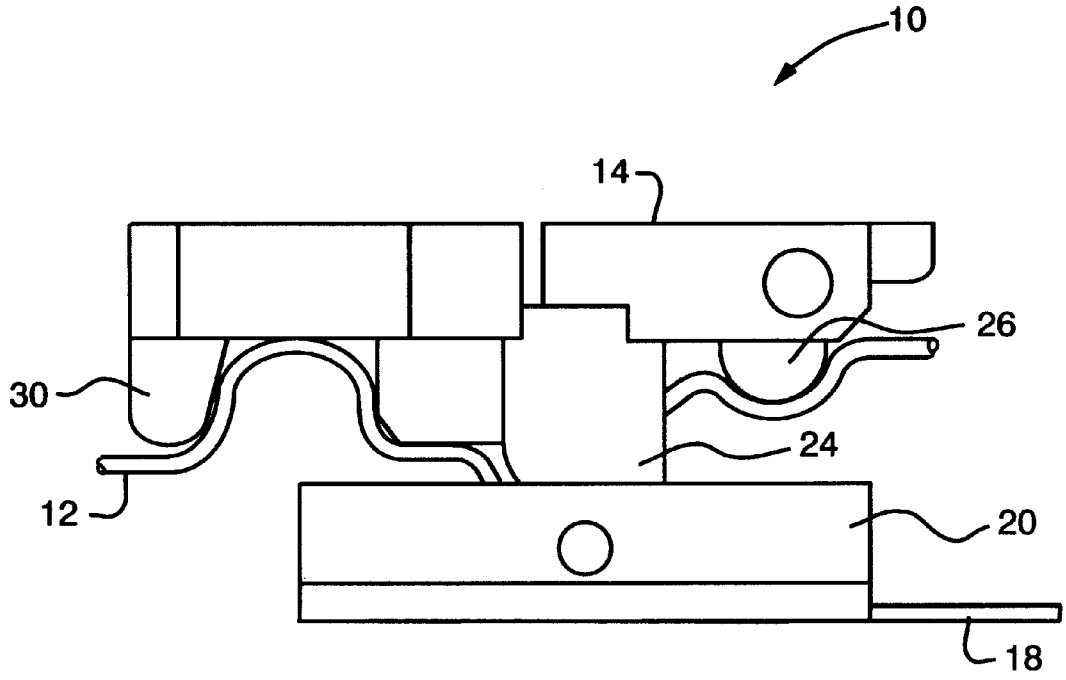
FIG. 4 is a side cut-away view of the connector, activated, showing the actuator/activator and spring support module.
Figure 5:
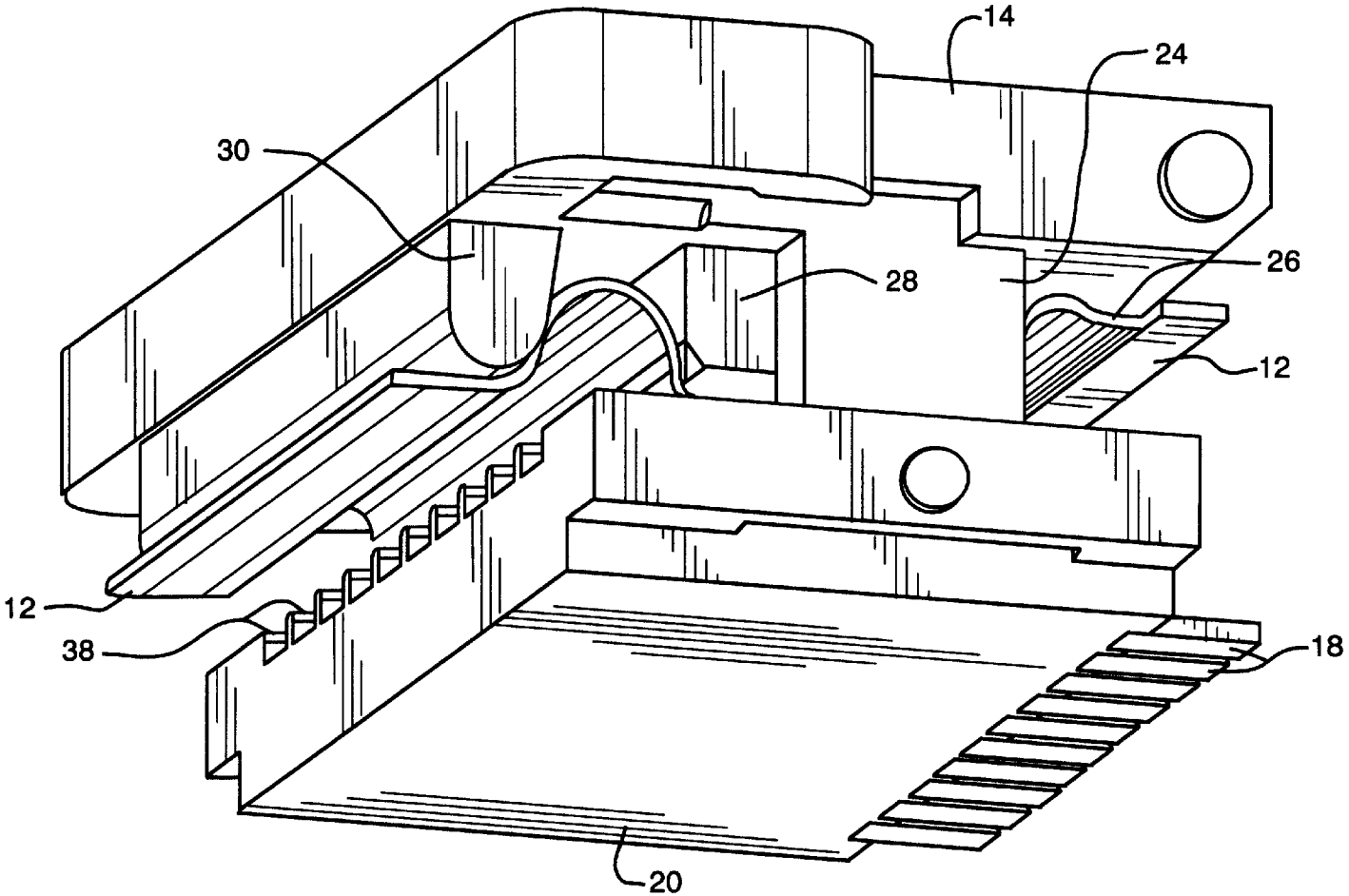
FIG. 5 is a perspective view of the actuator/activator and the spring support module, activated.

FIG. 4 is a simplified, side view of the connector, minus the component retaining shell 16 for ease of viewing. FIG. 5 is a perspective view of the connector, without component retaining shell 16. The view in FIG. 5 better illustrates the spring contact alignment troughs 38 of spring support module 20, and also the compression flap 28 of actuator 14. FIGS. 6*a–c* are simplified top and side views of spring contact 18 showing a "free floating" end, a complete "bridge", and the individual contacts.

While various other changes coming within the scope of the invention may suggest themselves to those skilled in the art, the invention is not limited to the specific embodiments shown or described above, but rather the same is intended to be merely exemplary. It should be understood that numerous other modifications and embodiments can be devised by those skilled in the art that will fall within the spirit and scope of the principles of the invention.

What is claimed is:

1. A circuit to printed circuit board stored energy connector comprising:

an actuator that cooperates with a component retaining shell; and at least one spring contact housed in a spring support module wherein at least one flexible circuit is connected to a printed circuit board via said at least one spring contact upon closing of said actuator upon said at least one spring contact and said at least one flexible contact.

2. The connector of claim 1 wherein said component retaining shell comprises:

at least one tapered circuit receiving cavity to initially receive said at least one flexible circuit into said connector;

tapered conductor alignment notches that receive and align said at least one flexible circuit; and at least one circuit retaining button receptacle that receives said circuit retaining button of said actuator to secure said at least one flexible circuit in said connector.

3. The connector of claim 1 wherein said at least one spring contact comprises a flat, flexible spring.

4. The connector of claim 3 wherein said at least one spring contact is free floating in said spring support module.

5. The connector of claim 3 wherein said at least one spring contact is connected, forming a bridge, in said spring support module.

6. The connector of claim 1 wherein said spring support module comprises:

spring contact alignment troughs to align said at least one spring contact with said at least one flexible circuit;

at least one contact deflection trough into which said spring contact and said at least one flexible circuit are compressed upon closing of said actuator; and at least one locating arm receptacle that cooperates with said circuit locating arms to align said at least one flexible circuit in said connector.

7. A method of interconnecting at least one flexible circuit to a printed circuit board using a connector comprising the steps of:

inserting said at least one flexible circuit into a tapered circuit receiving cavity in a component retaining shell to initially align said at least one flexible circuit in said connector;

holding said at least one flexible circuit essentially in place using a circuit retaining button formed as part of an actuator, and a corresponding circuit retaining button receptacle in said component retaining shell;

using circuit locating arms of said actuator to align said at least one flexible circuit in position over tapered conductor alignment notches formed in said component retaining shell, and over at least one spring contact housed in a spring support module, as a second alignment step;

providing further alignment and support of the connection using locating arm receptacles in said spring support module to receive and interact with said locating arms of said actuator;

using a compression flap of said actuator to guide individual contacts of said flexible circuit into said tapered alignment notches and aid in securing said at least one flexible circuit in said connector;

providing support and additional alignment for said at least one spring contact using spring contact alignment troughs to further align the individual contacts of said at least one flexible circuit to the individual contacts of said at least one spring contact in said spring support module;

completely closing said actuator and thereby applying force to said at least one flexible circuit using a contact activation ridge on said actuator;

whereby, the individual contacts of said at least one flexible circuit are micro-wiped as they are pressed, by said contact activation ridge, into firm connection with the individual contacts of said spring contact in a contact deflection trough in said spring support module to form the interconnection;

additionally using a strain relief extension on said actuator to provide further stabilization to the interconnection; and completing the interconnection by soldering a leading edge of said spring contact, which extends out from said connector, to a printed circuit board.

* * * * *